US008322362B2

(12) United States Patent
Walls

(10) Patent No.: US 8,322,362 B2
(45) Date of Patent: Dec. 4, 2012

(54) BACKUP PNEUMATIC WATER PRESSURE DEVICE

(75) Inventor: Judson E. Walls, Warrenton, VA (US)

(73) Assignee: Ethosystems, LLC, Warrenton, VA (US)

( * ) Notice: Subject to any disclaimer, the term of this patent is extended or adjusted under 35 U.S.C. 154(b) by 711 days.

(21) Appl. No.: 12/534,106

(22) Filed: Jul. 31, 2009

(65) Prior Publication Data

US 2012/0211103 A1 Aug. 23, 2012

Related U.S. Application Data

(60) Provisional application No. 61/085,412, filed on Jul. 31, 2008.

(51) Int. Cl.
*F04F 1/00* (2006.01)

(52) U.S. Cl. ..... 137/209; 137/487; 220/723

(58) Field of Classification Search ..... 137/206, 137/207, 209, 487; 220/720, 723; 222/386.5
See application file for complete search history.

(56) References Cited

U.S. PATENT DOCUMENTS 1,674,341 A * 6/1928 Penn ..... 137/211
2,412,107 A * 12/1946 Tannehill ..... 417/38
3,331,328 A * 7/1967 Smith et al. ..... 137/209
4,304,526 A * 12/1981 Shetler, Sr. ..... 417/38
5,205,316 A * 4/1993 Pruett ..... 137/209
5,218,986 A * 6/1993 Farwell ..... 137/209
5,240,043 A * 8/1993 Campbell ..... 137/211
5,555,997 A * 9/1996 Nogles ..... 220/723
5,647,392 A * 7/1997 Roche ..... 137/207
5,901,744 A * 5/1999 Richards ..... 137/202
6,041,742 A * 3/2000 Drake ..... 220/723
6,484,907 B1 * 11/2002 Evans ..... 222/334
6,726,052 B1 * 4/2004 Miller ..... 220/723
7,234,484 B2 * 6/2007 Laws et al. ..... 137/209
7,252,088 B1 * 8/2007 Nieves-Ramirez ..... 128/204.18
7,287,543 B2 * 10/2007 Wu ..... 137/209

* cited by examiner

*Primary Examiner* — Eric Keasel
(74) *Attorney, Agent, or Firm* — Whitham, Curtis & Christofferson & Cook, P.C.

(57) ABSTRACT

A water pressure backup device has a water tank mounted between a water source and interior plumbing lines and containing an air bladder that is inflated by a battery powered compressor when water pressure is lost at the source, bladder inflation within the tank thereby providing auxiliary water pressure to the interior plumbing lines. A control unit detects when water pressure at the source is lost, and monitors air pressure in the bladder and water pressure in the tank. When water pressure is restored at the source, the control unit shuts off the compressor and opens an air pressure relief valve at the bladder.

27 Claims, 5 Drawing Sheets

Example 40 Gallon Configuration

| | Gallon/Min Demand | Minutes Available | Cubic Feet/Min (CFM) Demand | Compressor CFM @ 30 PSI | Compressor CFM @ 50 PSI | |
|---|---|---|---|---|---|---|
| Example system operating range for continuous minimum pressure of 30 PSI | 1 | 40.0 | 0.13 | 0.85 | 0.67 | Example system provides continuous minimum pressure of 30 PSI within the demand range |
| | 2 | 20.0 | 0.26 | 0.85 | 0.67 | |
| | 4 | 10.0 | 0.52 | 0.85 | 0.67 | |
| | 5 | 8.0 | 0.65 | 0.85 | 0.67 | |
| | 6 | 6.7 | 0.78 | 0.85 | 0.67 | |
| | 6.54 | 6.1 | 0.85 | 0.85 | 0.67 | |
| Water demand exceeds example system | 7 | 5.7 | 0.91 | 0.85 | 0.67 | Water demand exceeds example system |
| | 8 | 5.0 | 1.04 | 0.85 | 0.67 | |
| | 12 | 3.3 | 1.56 | 0.85 | 0.67 | |
| | 16 | 2.3 | 2.08 | 0.85 | 0.67 | |

415

Figure 4

BACKUP PNEUMATIC WATER PRESSURE DEVICE

RELATED APPLICATION

This application claims priority from U.S. Provisional Application Ser. No. 61/085,412 having the same title and filed on Jul. 31, 2008.

BACKGROUND OF THE INVENTION

1. Field of the Invention

The present invention generally relates to devices for maintaining water pressure in water systems where water pressure is lost.

2. Background Description

Throughout the world, building structures (homes and businesses) rely on external sources of water (private well, public water utilities, or community water systems). These water systems are dependent upon private or public/community provided sources of water and water pressure. Water pressure can be lost from a variety of electrical or mechanical failures in the systems that supply water. For systems whose water pressure depends upon electrical power, loss of electrical power to the system can cut off the water supply. Events such as weather, natural disaster, electrical grid malfunctions, terrorist attack on utility systems, or electrical problems within the building structure, may then leave occupants of the home or building without water. For periods of time where loss of water can be an inconvenience, activities requiring a supply of running water may have to be rescheduled or delayed. For extended periods of time, this loss of water can lead to unsanitary conditions that can be detrimental to health.

There are a number of prior art responses to the cutoff of water pressure, or the prospect that water pressure may be cut off. For example, some building occupants may prepare for the loss of externally provided water by investing in an on-site storage and delivery system. The occupants then store water in a range of container sizes to ensure a short term supply of potable water, or water required for their business operations. These types of systems will typically utilize the force of gravity to provide limited pressurization of their stored water supply. However, it is often difficult to position this stored water in such a fashion that adequate pressure is obtained by gravity.

A simpler—but not uncommon—approach, when expecting or experiencing the loss of power to a building, particularly those on a well system, is for its occupants to purchase water on the consumer market for use during the power outage. Snow storms, electrical storms, tornadoes, and hurricanes, for example, can all cause the loss of power to a building, and by extension, to its well pump. Local consumer markets, anticipating the demand for purchased water, typically sell water in a range of container sizes. While making water available for purchase provides water for the most basic requirements, this alternative can be expensive, and inconvenient, as the consumer must travel to a store providing the water for sale on the local market. Some buildings on well systems are not conveniently located to a point of water sale, or travel to a store to purchase water is difficult, at best, or hazardous to impossible, should an ice storm, heavy snow, or flooding, for example, be responsible for the loss of electrical power to the building's well pump or the community water supply.

Additionally, in areas preparing for or experiencing a wide loss of community provided water pressure, or where the integrity of the water supply may be in question, it is not uncommon for the local, state, or federal governments to make water available in portable containers, or by delivering potable water to communities at centralized delivery locations. Again, the very environmental or infrastructure conditions responsible for the loss of power or interruption in service from a community water supply may make travel to the centralized water supply point difficult or hazardous.

Electrical generators provide another alternative in the event that loss of electrical power is the cause of an interruption in water pressure. For buildings whose water supply is provided by a well pump system, external generators, either portable or permanently installed and automatically activated, can provide electrical power to a well pump during the loss of utility provided electrical power. In this alternative, the generator may be connected directly to the electrical circuit of the well pump, or may be connected to the building's main power panel to provide power to a range of the building's components requiring electrical power, including the well pump.

In the most cost-effective instantiation of this alternative, the generator must be physically connected to the electrical components, manually started, and periodically refueled and maintained. Additionally, the generator must be located outside of the building due to hazardous fumes created by the generator. Particularly for private residences, the least costly generators will provide the basic electrical requirements only to a select group of 120 volt A/C appliances or building components, and may require the use of extension cords into which the appliances or components will connect to the generator.

Generator alternatives that are permanently installed, connected to the building's main power panel, and automatically activated when there is a loss of externally provided power, must also need to be periodically refueled and maintained. Also, if sufficiently sized to provide 240 volt A/C power for a building's largest power consuming components, this alternative will be very expensive compared to other alternatives, unless there are other economic reasons besides restoration of water pressure justifying investment in a generator.

The prior art also provides mechanisms for controlling pressure variations in water systems, but these pressure control systems do not provide for simple interruption or loss of water pressure for any length of time. For example, U.S. Pat. No. 7,013,924 discloses a fluid pressure system having a free floating gas or air filled bladder that serves to absorb pressure variations transmitted within a closed system. There is no indication that the pressure regulation mechanism would be operable to maintain pressure more than momentarily where there is a complete loss of water pressure.

None of the foregoing alternatives provide a satisfactory substitute for water pressure that has been lost. What is needed is a simple and inexpensive system for restoring water pressure which has been interrupted for a significant period of time.

SUMMARY OF THE INVENTION

It is therefore an object of the present invention to provide a simple and inexpensive backup system for restoring water pressure which has been interrupted, whether the interruption is due to loss of electrical power in a well system, failure of the well system pump, or failure of pressure in a public or community water supply system due to a broken water main or other mechanical or electrical outages.

It is a further object of the invention to provide a backup water pressure system that dynamically restores water pressure which has been interrupted.

Yet another object of the invention is to provide a backup water pressure system that restores itself to a ready state when the pressure which has been interrupted is restored.

This battery-powered pneumatic emergency water supply system will provide a sizable reserve of pressurized water to occupants of the building structure. A battery-powered pneumatic emergency water supply system for structures having an existing external water supply system serving the structure is described herein, although the invention may also be implemented with other power configurations, including the use of solar power based electrical supply systems.

In one embodiment the invention is a backup pneumatic water pressure device, comprising: a water tank connected between a water supply and plumbing lines providing water service to a building structure, the water service relying upon a primary water pressure at the water supply; means for pressurizing the tank to maintain the water service through the plumbing lines when the primary water pressure is interrupted; and means for relieving the pressure applied by said pressurizing means and restoring water in the water tank when the primary water pressure at the water supply is restored.

In this embodiment the pressuring means further comprises: an inflatable air bladder inside the water tank; an air compressor for inflating the air bladder; and means for powering the air compressor when the primary water pressure is interrupted. The means for powering the air compressor may be a storage battery, which may be recharged, for example by means of a solar power generator.

The relieving and restoring means further comprises: means for sensing restoration of the primary water pressure; means for disconnecting the air compressor from power responsive to said sensing means; and means for opening a relief valve attached to the air bladder in response to said sensing means. This embodiment may further comprise means for detecting the interruption in the primary water pressure, for example, via a relay connected to a power outlet in the building structure if the primary water service is provided by a well system operated by electricity from the building structure, or more generally by a relay (128 in FIG. 1) connected to a water pressure sensor (131 in FIG. 1) for determining water pressure into the water tank.

This embodiment of the invention may be extended by connecting one or more additional pressure tanks connected in series. These pressure tanks may be controlled by their own control units, or from a single control unit.

This embodiment of the invention may be implemented by adapting the powering means to turn the air compressor on when a pressure in the water tank is less than a pre-set lower limit and turn the air compressor off when the pressure in the water tank is greater than a pre-set upper limit. Further, the pre-set lower limit and the pre-set upper limit may be adjusted to limit a cycling strain on the air compressor. Further, the air compressor may be sized in relation to a capacity of the water tank and in relation to an estimated water usage demand to limit a cycling strain on the air compressor.

Another embodiment of the invention is a backup pneumatic water pressure device, comprising: a water tank connected between a water supply and plumbing lines providing water service to a building structure, the water service relying upon a primary water pressure at the water supply, the water tank being pressurized and having an internal air bladder; an air compressor connected to the air bladder, the air compressor being operated to pressurize the air bladder when a water pressure within the tank is less than a preset lower pressure limit, the air compressor ceasing operation when the water pressure within the tank is greater than a preset upper pressure limit; an independent power supply for the air compressor; and a check valve between the water supply and the water tank to maintain pressure in the water tank provided by operation of the air compressor when there is a loss of water pressure from the water supply.

In this embodiment of the invention the water pressure is measured by a pressure sensor switch connected to the water tank and integrated within a control unit operable to apply power from the independent power supply to the air compressor.

BRIEF DESCRIPTION. OF THE DRAWINGS

The foregoing and other objects, aspects and advantages will be better understood from the following detailed description of a preferred embodiment of the invention with reference to the drawings, in which:

FIG. 4 is a chart showing operating ranges for the water supply provided by the invention in an exemplar configuration shown by FIG. 3.

DETAILED DESCRIPTION OF A PREFERRED EMBODIMENT OF THE INVENTION

Figure 1:
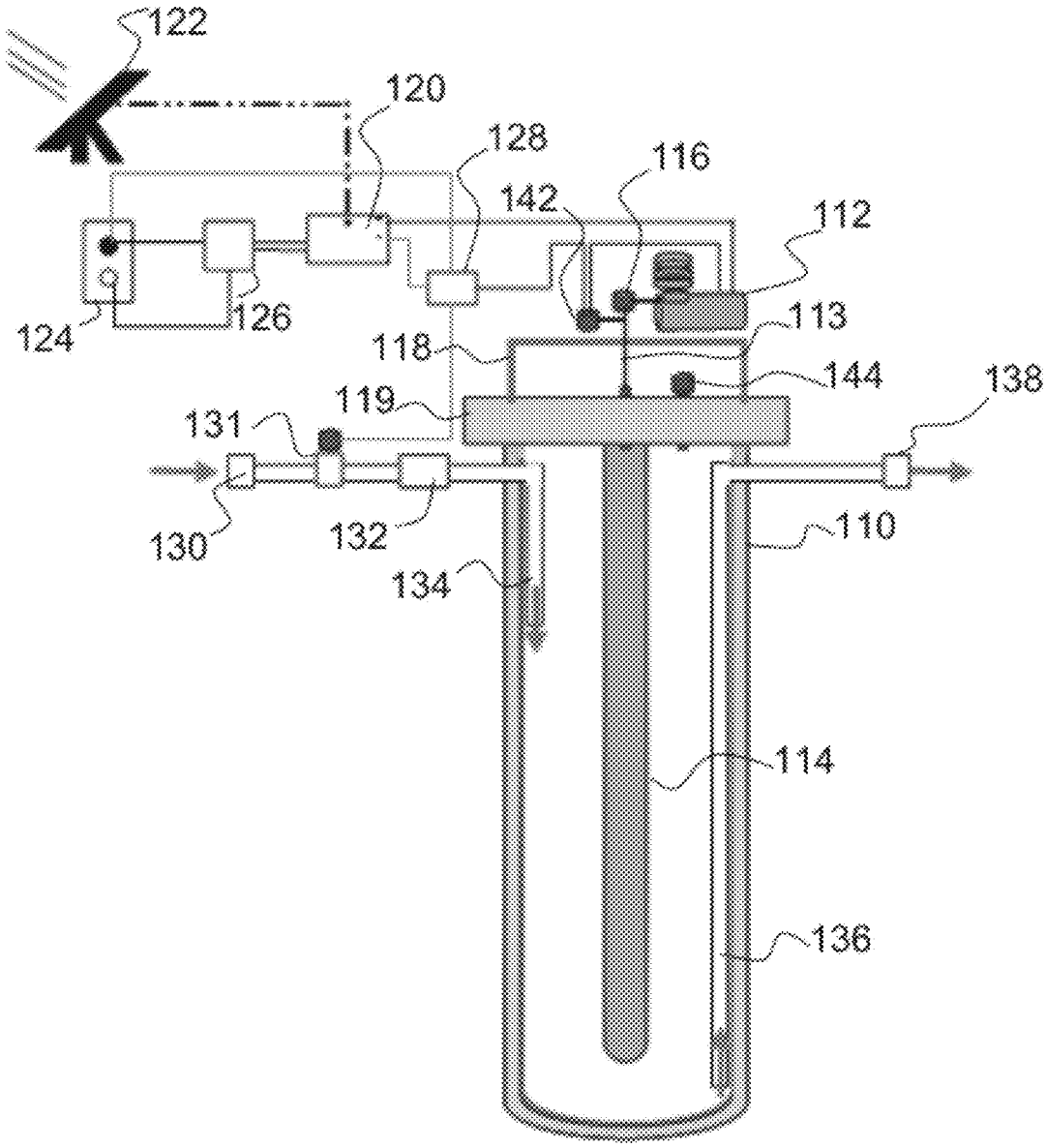
FIG. 1 is a schematic diagram of an exemplar implementation of a backup pneumatic water pressure system in accordance with the invention.

Under normal power available to well pump or public/community water pressure systems, buildings have water pressure available on demand to faucets, appliances, toilets (266 in FIG. 2), hose bibs (268 in FIG. 2), operating requirements for business, etc. The water pressure available in the building is determined by the size of the well pump motor, size of pipes providing water to or within the building, the number of users drawing upon a common water system at any given time.

Characteristically, the loss of power to a building on a well system will also result in the loss of water pressure in the building. While some residual pressure may reside in the lines or within commonly installed well bladders, this pressure quickly falls to zero after a short water demand by the building occupant even though large quantities of water may still exist in a number of building components or infrastructure within the building water pipes, a well bladder (if installed), the hot water tanks, etc. Particularly for buildings whose water supply is provided via an electrically powered well pump, but also for any building experiencing loss of externally provided water pressure, the loss of electrical power to the well pump, or failure of the well pump, results in the almost immediate loss of water pressure within the building.

It is the intent of this invention to provide a means by which water pressure can be immediately restored to the building by operation of a battery-powered compressor, activated automatically in response to the loss of building electricity or failure of a building's well pump, or loss of community or centrally provided pressurized water, to ensure that a reserve supply of water is provided with a pressurization mechanism that serves to replace the source of water pressure that has been interrupted and restore to the building's occupants the availability of water.

The present invention provides, in response to a loss of water pressure, automatic re-pressurization to within a preset range by means of a battery powered air compressor that inflates an air bladder within the confines of a pressure tank. In its preferred mode of operation, a system implementing the invention provides a water pressure feedback and control structure that operates the air compressor to expand the air bladder to a preset upper pressure limit, turns the air compressor off until the pressure decreases to a preset lower pressure limit, and then turns the air compressor on again. This duty cycle is repeated, maintaining water pressure within the preset range. As those skilled in the art will appreciate, the preset range may be coordinated with the capacity of the air compressor, the size of the water tank and estimates of water usage during a backup emergency to ensure that the duty cycle between the preset lower pressure limit and the preset upper pressure limit and back again is of sufficient length that the air compressor is used efficiently and is not strained by rapid cycling.

During normal operations of a well system or a community-provided water system supplying the building's water needs, the water tank is filled to its capacity at the provided pressure. By combining a pressure tank containing an expandable air bladder with a control unit containing components to provide and manage compressed air in the internal air bladder within the pressure tank, and therefore the water pressure within the tank, pressurized water can be provided to a building for an extended period of time, based on the size of the pressure tank and the size of the battery relative to the electrical draw of the air compressor, to ensure the water needs of the buildings occupants while waiting for power to be restored, maintenance or repair of the well system to be completed, or community provided water pressure to be restored to the building.

The present invention may be implemented in a variety of configurations based on the fundamental design, including vertical and horizontal pressure tank layouts, integrated and free standing control units configurations for both vertical and horizontal pressure tank configurations, battery sizes varying according to the pressure tank/stored water requirements and desired water pressure, and air compressors providing a range of volume and pound-per-square-inch capabilities.

The battery-powered pneumatic emergency water supply system includes a water holding structure (system tank) with a removable top capable of being sealed so the tank can hold pressurized water. The design of this system allows it to be scaled up or down in size to meet the emergency water capacity requirements of the building structure. The system tank has water inlet and outlet connections that can be connected, in series, to the existing building structure water supply lines. Under conditions where electrical power is available to the building structure or external water supply, water pressure is provided to the building structure 260 from water systems outside the building structure (well pumps 264 or publicly-provided water utilities 262), water enters the system tank from the external water supply and flows unimpeded through the tank when water is demanded by opening of a water valve (faucet tap, toilet flush, etc.) within the building structure.

Water is prevented from flowing back into the external water supply system by means of a check valve installed between the system tank and the external water supply. This check valve may be installed in conjunction with the building's existing well or other water supply system, or may be installed in conjunction with installation of an embodiment of the present invention.

The system tank has an internal air bladder that expands with compressed air supplied by an air compressor attached the system tank by an air pressure line or hose. The air compressor in this embodiment is battery-powered. Battery power is applied to the air compressor by an electrical relay during a loss of electrical power to the building structure. When electricity is available to the building structure, the system battery is charged by an integral electrical power converter that receives alternating current from an electrical outlet within the structure. Or the integral power converter may be connected directly to the building's main power panel. Alternatively, the battery can be charged by connection to a solar panel system outside of the building structure.

When connected to an electrical outlet or to the building's main power panel, the alternating current electricity is converted to direct current via the integral power converter and is applied to the battery maintaining the battery charge. Direct current from a solar panel connection can charge the battery without need for power conversion. In some installations the system can be completely powered by solar power, eliminating the need for the battery.

During the loss of electrical power to the building structure, the electrical relay allows direct current to flow from the battery to the air compressor. The electrical relay also closes a bladder pressure relief valve allowing the air bladder to be inflated with compressed air from the air compressor. The air compressor inflates the air bladder within the system tank to a preset level of air pressure.

When power to the building or well pump is restored, the control unit will deactivate the system allowing the air bladder within the pressure tank to deflate and water from the well pump to refill the pressure tank. The battery is sized to permit a number of power loss/power restore cycles by the battery-powered pneumatic emergency water system.

For example, in a 40 gallon pressure tank configuration of this system, an 18 ampere/hour battery connected to an air compressor drawing 14 amperes of current could provide almost 1.28 hours of air compressor operation, and therefore, pressurized water for an hour and a quarter. A typical faucet within a residential home provides two gallons of water per minute when fully opened. Therefore, in this example, the battery-powered pneumatic emergency water system could provide pressurized water to the building, within a preset pressure range, for up to twenty minutes, before depleting the water available within the pressure tank.

Should electrical power be restored to the building, the battery-powered pneumatic emergency water system deactivates allowing water to be restored to the pressure tank as the well-pump begins operating again. Again, as an example, if power to the well pump providing 8 gallons per minute were restored, the pressure tank could be refilled with water by the well pump within five minutes. A battery-powered pneumatic emergency water system, in this example, could provide for up to almost four complete system cycles on one full battery charge. As the battery would recharge during the intermittent power restored condition, it is expected the system could provide more that four complete system cycles. Larger water demands created by opening more than one faucet or other water consuming device within the building would reduce the amount of pressurized water provided by the system. For larger water demand requirements, this implementation of the invention may be suitably scaled in all its components to meet the water demands of the building occupants and other water requirements included in the design of the building. As will be appreciated by those skilled in the art of water supply system designs, it is also feasible to design a backup water delivery system using the present invention so that bibs servicing lower priority services such as exterior gardens or swimming pools are shut off during a backup emergency.

A pressure sensor detects the desired pressure range for the internal bladder and will activate and deactivate the air compressor as required to increase the amount of pressurization within the internal bladder, and therefore within the pressure tank itself. Inflating the bladder inside the system tank applies positive pressure to the water inside the tank. This positive pressure forces water from the system tank outlet line into the building structure plumbing when a water valve (faucet tap, toilet supply line, shower, etc.) is opened. As water flows from the system tank, air pressure within the air bladder will decrease due to the expansion of the bladder permitted by the decreased water level within the system tank. When the pressure in the system tank falls below the preset level, the pressure sensor switch allows direct current from the battery to be applied to the air compressor. The air compressor will again force compressed air through the air pressure line or hose and into the air bladder within the system tank. The pressure sensor switch will ensure the proper preset level of air pressure is maintained within the system tank. Maintaining system tank pressure within the preset range will continue to force water through the internal building structure plumbing lines in response to water user demand inside the building, until the water supply within the pressure tank is exhausted.

When electrical power is restored to the building structure or external water supply system, the electrical relay removes battery power from the air compressor and a bladder pressure relief valve opens to permit the flow of water through the system tank under pressure from the building's external water source. The bladder pressure relief valve is opened when electrical power is restored, permitting the compressed air bladder within the system tank to bleed off. Allowing the air bladder to completely deflate has two effects. First, it permits the maximum amount of water to refill the system tank. Second, it creates a negative pressure within the system tank that will create a draw of water from the external water supply and minimize the amount of air that may be trapped inside the system tank.

In addition to the system components described above, a trapped air relief valve is designed into the system tank lid and permits release of trapped air inside the system tank during initial installation or periodically to ensure trapped air hasn't developed when the emergency system is inactive. In one embodiment an external equipment mount is attached to the lid of the system tank and serves as a mounting point for the system control unit containing the battery-powered pneumatic emergency water supply system components.

Figure 3:
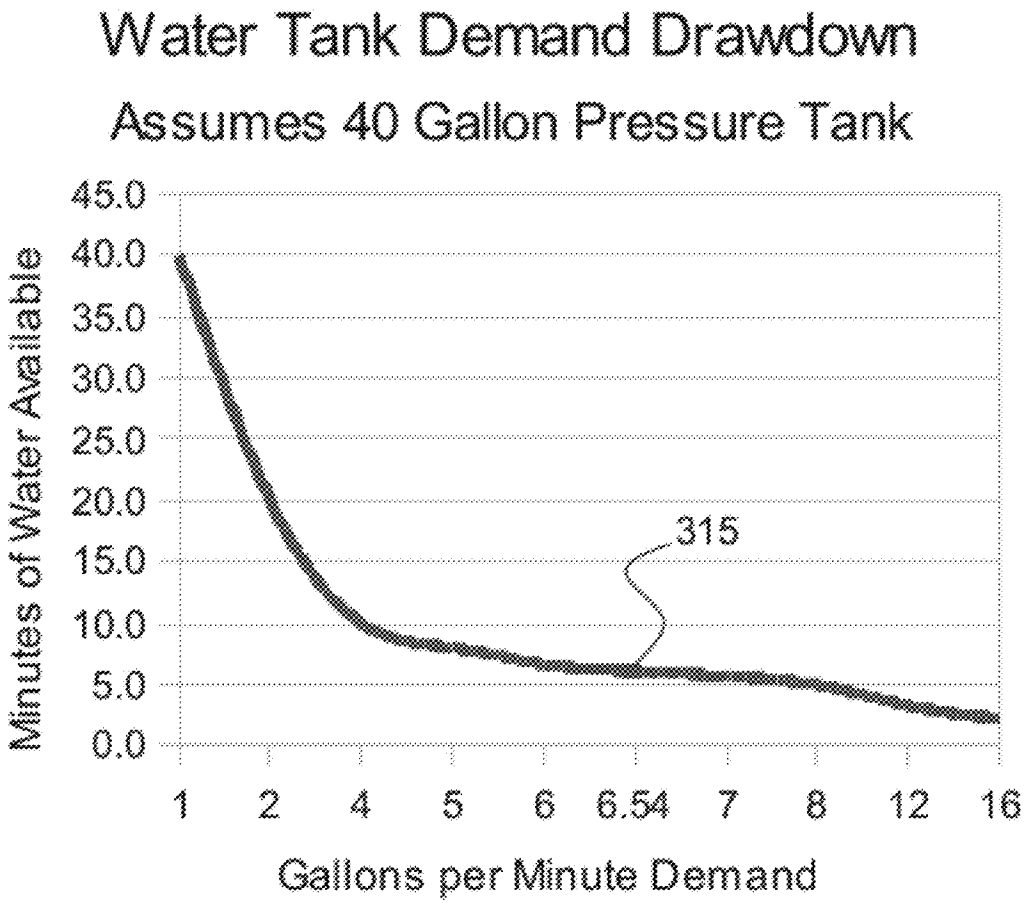
FIG. 3 is a graph showing demand drawdown of a water tank in an exemplar scenario.

With reference to FIGS. 3 and 4, it will be observed that for the scenario depicted there is a point shown (by item 315 in FIG. 3 and item 415 in FIG. 4) where the water demand is just barely met, and beyond which (at a level of 6.54 gallons per minute demand) the capacity of the system is exceeded.

Figure 2:
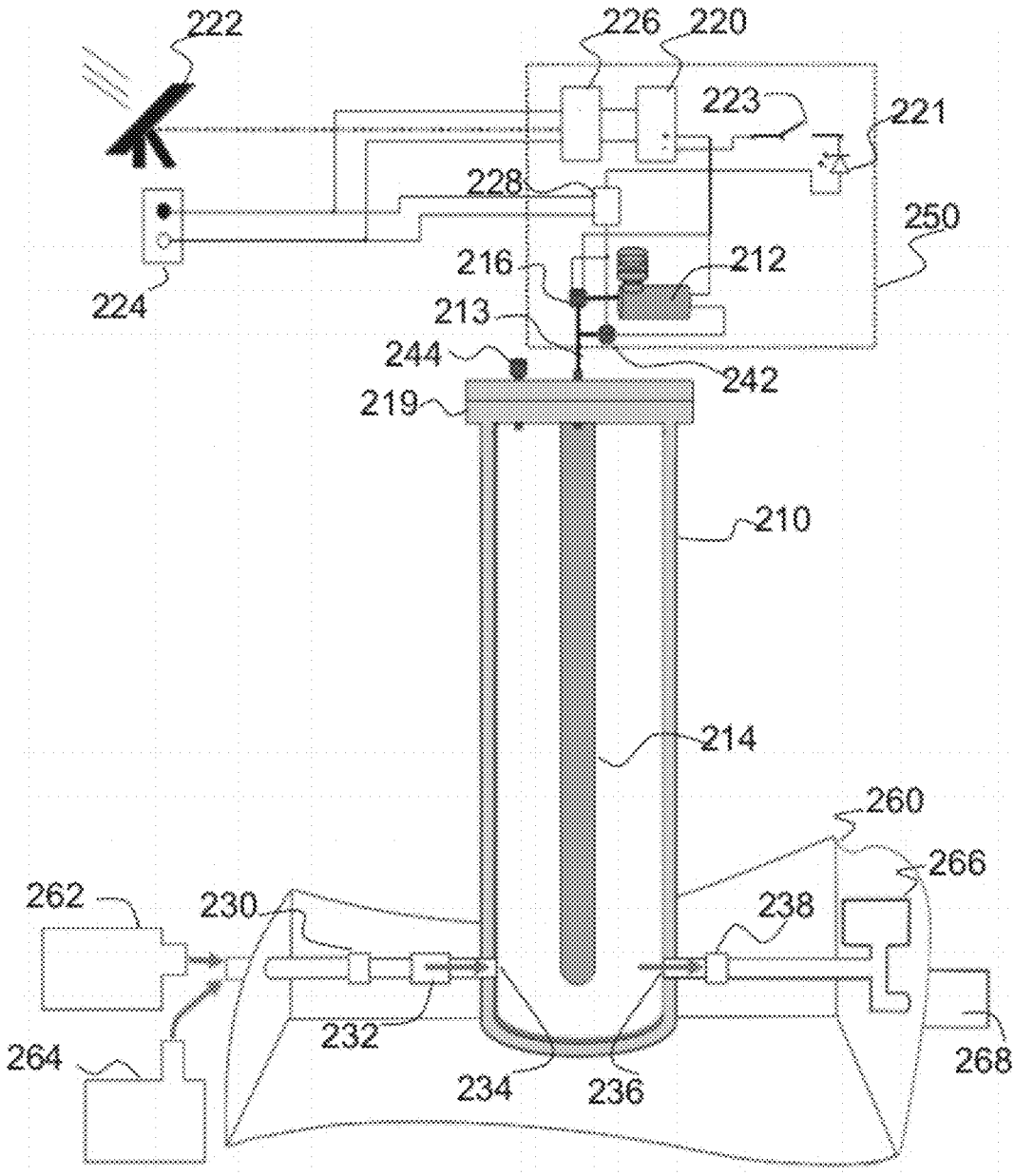
FIG. 2 is a schematic diagram of a second exemplar implementation of a backup pneumatic water pressure system in accordance with the invention.

Referring now to FIGS. 1 and 2, there is shown exemplar implementations of the invention, which will now be described with reference to its components.

Pressurized Tank (System Tank; 110, 210)—When normal, utility-provided, electricity is available to the building structure and to any local water system (such as a well system) that depends upon such electricity, or if water pressure is available from a community-provided water supply source, water flows through the pressurized tank. When the building structure loses utility-provided electricity for a well pump, or there is a failure of the well pump, or there is a loss of water pressure from a community provided source, the pressurized tank serves as a backup or emergency water supply and is pressurized via air from the compressor being pumped into the internal air bladder that is inside the system tank. Water remaining in the pressurized tank serves as the storage supply for water during activation of the battery-powered pneumatic emergency water supply system.

Air Compressor (112, 212)—The compressor injects air into the internal air bladder when power from the system battery is applied to the compressor during electrical failure or loss of water pressure to the building structure.

Internal Air Bladder (114, 214)—The internal air bladder is used to provide pressure within the pressurized tank and force water out into the building structure water lines during power-out conditions. In power-out conditions or during a loss of externally provided water pressure, the air compressor forces air through the air pressure line, into the internal air bladder. This compressed air forces the internal air bladder to expand, and this expansion pressurizes the water in the system tank. When a faucet or valve is opened during operation of a device within the building structure, water pressured by expansion of the air bladder flows from the pressurized tank.

System Battery (120, 220)—The system battery is the source of direct current electricity for the air compressor in a building structure power-out condition. Battery power is supplied to the air compressor via the electrical relay when the electrical relay is de-energized during power-out or water pressure loss conditions. During power-on conditions or upon restoration of externally provided water pressure, the electrical relay is energized and the air compressor remains off.

AC-to-DC Power Supply/External Solar Panel Power System (126, 226)—The AC-to-DC power supply system (alternatively, the external solar power system) is used to convert utility-provided electricity into the proper direct current voltage necessary to maintain a charge on the system battery.

In-line Check Valve (132, 232)—The in-line check valve is used to prevent pressurized water from flowing back into the external water supply during operation of the battery-powered pneumatic emergency water supply system. Under normal electricity operation, water flows unimpeded past the check valve into the system tank.

Air Relief Valve (144, 244)—The air relief valve is used to release any air that may accumulate within the water tank during the initial installation and filling of the system tank and during transition of the system from an operational mode where the water in the tank is depleted to an off-duty mode where the air bladder is deflated and the water tank is refilled.

Pressure Sensor Switch (142 , 242) The pressure sensor switch measures the internal pressure of the system tank. This measurement provides the signal information required for operation of the air compressor control structures whose logic keeps the water pressure produced by the backup system within a preset range.

Air Pressure Line (113, 213)—The air pressure line connects the air compressor to the internal air bladder, and is through which air will travel from the compressor to the internal air bladder during power-out conditions or other causes for loss of water pressure to the home.

Plumbing Fittings (130, 230; 134, 234; 136, 236; 138, 238)—Standard copper or PVC plumbing fittings are used to connect the battery-powered pneumatic emergency water supply system in-line to the building structure's main water line. These fittings include the mechanical connections on the water supply side and the building structure side, as well as the openings and flow structures (e.g. pipes to direct water flow) within the water tank.

Electrical relay (128, 228)—The electrical relay is connected between the system battery and pressure sensor switch. When electricity or external water pressure is available to the building structure, the relay energizes and removes system battery power from the compressor. When power loss or water pressure loss to the building structure occurs, the electrical relay de-energizes and system battery power is applied to the air compressor which pressurizes the internal air bladder.

Bladder Pressure Relief Valve (116, 216)—This valve is open during power-on conditions and closed during power-off or pressure loss conditions. When open, air pressure within the internal air bladder is released, the internal air bladder will deflate allowing the water to fill from the external source of pressurized water. This value is closed during power-out or pressure loss conditions, thereby allowing operation of the air compressor to increase pressure within the internal air bladder to a preset upper limit of a pressure range.

External Equipment Mount (118)—Serves as a platform for mounting external system components to the pressurized tank.

Table of Component Operation During Water Pressure Conditions

| Item Number | Component | Utility Power-On/Water Pressure Available | Utility Power-Off/Pressure or Well Pump Failure |
|---|---|---|---|
| 110, 210 | Pressurized Tank | Water flows through tank pressurized by the water supply system outside of the building (well pump or externally provided water source). | Water retained in tank under pressure provided by pneumatic system. Water is prevented from exiting the tank toward the external water supply by the one-way check valve installed up-stream of the pneumatic system. |
| 112, 212 | Air Compressor | Power is removed from the air compressor by the energized electrical relay between the battery and the air compressor | Power from the battery is applied to the air compressor by the energized electrical relay between the battery and the air compressor. When the pressure is less than a pre-set lower limit the air compressor will pump air through the air line into the air bladder until the pressure reaches a preset upper limit, as sensed by the air pressure switch, or until a utility power-on condition is restored. |
| 114, 214 | Internal Air Bladder | Internal air bladder is without pressure | Internal air bladder is pressurized by the air compressor if the pressure is below a pre-set tank lower pressure limit; pressurization continues until a pre-set tank upper pressure limit is sensed by the pressure sensor switch or a utility power-on condition is restored. |
| 120, 220 | System Battery | The battery is charged by the AD-to-DC Power Supply that is connected to the home electrical outlet. Alternatively, the battery can be charged by DC power provided by an external solar power system. The battery power is disconnected from the air compressor via the electrical relay. | The battery is connected to the air compressor via the de-energized electrical relay and through the air pressure sensor shut-off switch. |
| 126, 226 | AC-to-DC Power Supply Alternative: External Solar Power System | The AD-to-DC Power Supply is plugged into the home electrical outlet and provides DC power to the system battery. Alternatively, DC power can be provided by an external solar power system. | The AD-to-DC Power Supply remains plugged into the home electrical outlet, but will not provide charging power to the battery until a utility power-on condition is restored. Alternatively, DC power from an external solar power system can continue to charge the battery. |
| 132, 232 | In-line Check Valve | The in-line check valve permits the normal flow of water from the well-pump or external water supply | The in-line check valve blocks the flow of water from the pressurized system tank back into the external water supply during a power-out condition or a well-pump failure |
| 144, 244 | Air Relief Valve | The Air Relief Valve should periodically be depressed to release trapped air within the pressurized tank that may be present | Upon restoration of a power-on condition, depress the air relief valve to ensure removal of air trapped within the tank after bladder is deflated. This will ensure that the maximum water capacity of the tank is available in a power-out/well-pump failure |

-continued

Table of Component Operation During Water Pressure Conditions

| Item Number | Component | Utility Power-On/Water Pressure Available | Utility Power-Off/Pressure or Well Pump Failure |
|---|---|---|---|
| | | | condition. |
| 142, 242 | Pressure Sensor Switch | No power is applied to the switch and has no function during this condition. | The switch senses the pressure within the air bladder and removes power from the air compressor above an upper limit and restores power when pressure reaches a lower limit, until a water draw-down rate limits the water pressure from the pressurized tank. |
| 113, 213 | Air Pressure Line | N/A | The air pressure line connects the air compressor to the air bladder for pressurizing the air bladder. |
| 130, 230, 134, 234, 136, 236, 138, 238 | Plumbing Fittings | Used to connect the system in-line between the water source and the home interior plumbing. | |
| 128, 228 | Electrical Relay | During a power-on condition or with external water pressure available, the relay is energized and prevents DC voltage from being applied to the air compressor. | When loss of water pressure is detected, the electrical relay is de-energized and power is applied to the air compressor through the Pressure Sensor Switch |
| 116, 216 | Bladder Pressure Relief Valve | During a power-on condition, the Bladder Pressure Relief Valve is energized and open permitting air pressure to release from the air bladder. This ensure the pressurized tank can remain filled to maximum capacity. | During a power-off condition, the Bladder Pressure Relief Valve is de-energized and closed to permit the air bladder to pressure within the pressurized tank. |
| 223 | System Manual On/Off Switch | Switch is manually positioned to select the desired operable/disabled condition | Switch is manually positioned to select the desired operable/disabled condition |
| 221 | System Condition Indicator | Indicator displays the inactive condition of the system | Indicator displays the active condition of the system |

Embodiments of the Invention

In a preferred embodiment, as shown in FIG. 2, the pressure tank containing the air bladder is designed to operate in a vertical state. The inlet and outlets at the bottom are integrated into the structure, the bladder is connected to the pressure tank's removable top opening, and the control unit is mounted to the top of the pressure tank structure. In a variation on this embodiment, the inlet and outlets at the top of the pressure tank are connected to impermeable pipes extending to the bottom of the pressure tank.

Alternatively, the control unit can be physically removed from the pressure tank structure for mounting independent from the unit, but connected to the pressure tank by means of the air supply line from the air compressor. In this embodiment, the control unit can be mounted above possible high water conditions that could disable the control unit and, therefore, system operation.

In a further embodiment, the pressure tank and internal bladder are oriented horizontally for installation in low height environments within the building. In this embodiment, the control unit may be mounted directly to the pressure tank or may be physically removed from the pressure tank structure for mounting independent from the unit, but connected to the pressure tank by means of the air supply line from the air compressor.

Figure 2A:
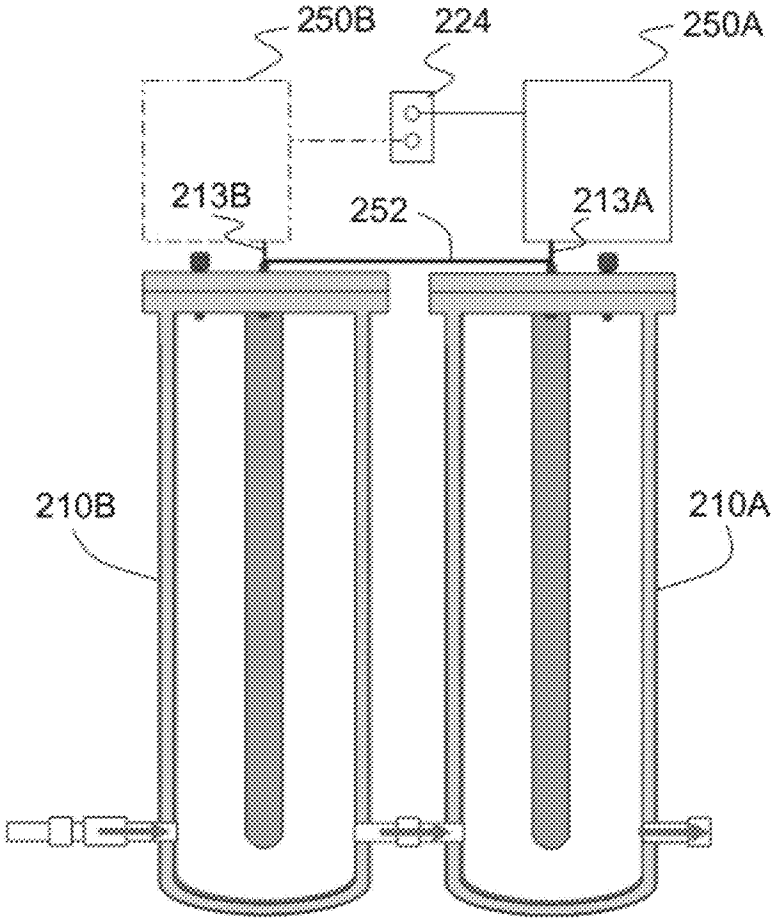

In another embodiment, multiple units (210A, 210B as shown in FIG. 2A) are connected in series with each other with separate control units (250A, 250B) for each tank. This embodiment includes both vertical and horizontal configurations described in the preferred embodiment and alternative embodiments. In this embodiment, the control unit may be mounted directly to the pressure tank or may be physically removed from the pressure tank structure for mounting independent from the unit, but connected to the pressure tank by means of the air supply line (213A, 213B) from the air compressor.

Yet another embodiment covers multiple pressure tanks (210A, 210B) connected in series with a single control unit 210A maintaining constant pressure across all of the tanks via linking air hose 252. This embodiment includes both vertical and horizontal configurations described in the preferred embodiment and alternative embodiments. In this embodiment, the control unit may be mounted directly to the pressure tank or may be physically removed from the pressure tank structure for mounting independent from the unit, but connected to the pressure tank by means of the air supply line from the air compressor.

In another embodiment the control unit contains a device for monitoring the current available from the battery to the other control unit components to prevent the operation of the system should battery current be insufficient such that operation of the system could damage other control unit components. The control unit may also contain sensors for measuring the internal air pressure of the bladder and the internal water pressure of the tank. The pressure sensors may be of analog or solid state design, and they may be preset or may be adjustable by the user. Also, the control unit may contain a unit for displaying the results sensed by the pressure sensors. The control unit may also contain a valve that allows for inflation and deflation of the air bladder.

It is also a variation on an embodiment of the invention for the pressurized tank to be made of a rigid material impermeable to water and which maintains its size and shape under varying pressures. It is possible for inlet and outlet openings for connecting the system to the internal water lines of the building structure to be integral to the physical molded structure of the pressure tank. In some embodiments the inlet and outlet openings may be tubes of rigid material extending within the pressure tank. In a further embodiment the pressure tank may include a removable cover that facilitates the manual addition of water to the tank during extended interruptions to primary water pressure to the structure.

While the invention has been described in terms of preferred embodiments, those skilled in the art will recognize that the invention can be practiced with modification within the spirit and scope of the appended claims.

The invention claimed is:

1. A backup pneumatic water pressure device, comprising:

a water tank connected between a water supply and plumbing lines providing water service to a building structure, the water service relying upon a primary water pressure at the water supply, the water tank being pressurized and having an internal air bladder;

an air compressor connected to the air bladder, the air compressor being operated automatically when the primary water pressure is interrupted to pressurize the air bladder, the water pressure being controlled dynamically by automatically operating the air compressor when a water pressure within the tank is less than a preset lower pressure limit, the air compressor ceasing operation when the water pressure within the tank is greater than a preset upper pressure limit, and automatically relieving pressure from the air bladder when the primary water pressure is restored, thereby restoring water in the water tank;

a power supply for the air compressor; and a check valve between the water supply and the water tank to maintain pressure in the water tank provided by operation of the air compressor when there is a loss of water pressure from the water supply.

2. A backup pneumatic water pressure device as in claim 1, wherein the water pressure is measured by a pressure sensor switch connected to the water tank and integrated within a control unit operable to apply power from the independent power supply to the air compressor.

3. A backup pneumatic water pressure device as in claim 1, further comprising one or more additional pressure tanks connected in series.

4. A backup pneumatic water pressure device as in claim 3, wherein each of the pressure tanks is controlled by its own control unit.

5. A backup pneumatic water pressure device as in claim 3, wherein a single control unit controls each of the pressure tanks.

6. A backup pneumatic water pressure device, comprising:

a water tank connected between a water supply and plumbing lines providing a water service, the water service relying upon a primary water pressure at the water supply;

means for automatically pressurizing the tank to maintain the water service through the plumbing lines when the primary water pressure is interrupted, said pressurizing means providing dynamic control of said backup pneumatic water pressure; and means for relieving the pressure applied by said pressurizing means when the primary water pressure at the water supply is restored, thereby restoring water in the water tank.

7. A backup pneumatic water pressure device as in claim 6, wherein said pressuring means further comprises:

an inflatable air bladder inside the water tank;

an air compressor for inflating the air bladder; and means for powering the air compressor automatically, responsive to interruption in the primary water pressure.

8. A backup pneumatic water pressure device as in claim 7, wherein the means for powering the air compressor comprises a storage battery.

9. A backup pneumatic water pressure device as is claim 7, further comprising means for recharging the storage battery.

10. A backup pneumatic water pressure device as in claim 9, wherein the recharging means is a solar power generator.

11. A backup pneumatic water pressure device as in claim 7, wherein said relieving and restoring means further comprises:

means for sensing restoration of the primary water pressure;

means for disconnecting the air compressor from power responsive to said sensing means; and means for opening a relief valve attached to the air bladder in response to said sensing means.

12. A backup pneumatic water pressure device as in claim 11, wherein said sensing means is a relay connected to a power outlet in a building structure housing the backup water pressure device.

13. A backup pneumatic water pressure device as in claim 7, wherein said powering means is adapted to turn the air compressor on when a pressure in the water tank is less than a pre-set lower limit and turn the air compressor off when the pressure in the water tank is greater than a pre-set upper limit.

14. A backup pneumatic water pressure device as in claim 13, wherein the pre-set lower limit and the pre-set upper limit are adjusted to limit a cycling strain on the air compressor.

15. A backup pneumatic water pressure device as in claim 13, wherein the air compressor is sized in relation to a capacity of the water tank and in relation to an estimated water usage demand to limit a cycling strain on the air compressor.

16. A backup pneumatic water pressure device as in claim 6, further comprising means for detecting said interruption in the primary water pressure.

17. A backup pneumatic water pressure device as in claim 16, wherein said interruption detection means is a relay connected to a power outlet in a building structure housing the backup water pressure device.

18. A backup pneumatic water pressure device as in claim 6, further comprising one or more additional pressure tanks connected in series.

19. A backup pneumatic water pressure device as in claim 18, wherein each of the pressure tanks is controlled by its own control unit.

20. A backup pneumatic water pressure device as in claim 18, wherein a single control unit controls each of the pressure tanks.

21. A backup pneumatic water pressure device as in claim 6, wherein the water service is provided to a hose bib.

22. A backup pneumatic water pressure device as in claim 21, wherein the water service to the hose bib is provided via a building structure.

23. A backup pneumatic water pressure device as in claim 21, wherein the water supply is provided by a well pump.

24. A backup pneumatic water pressure device as in claim 6, wherein the water service is provided to a building structure.

25. A backup pneumatic water pressure device as in claim 24, wherein the water service at the building structure is available on demand to water outlets including faucets, toilets, appliances and hose bibs.

26. A backup pneumatic water pressure device as in claim 25, wherein water service to the hose bibs is shut off during a backup emergency.

27. A backup pneumatic water pressure device as in claim 6, wherein the water supply is provided by one of the group comprising a well pump, public water utility, and community water system.

* * * * *